US009643411B2

(12) United States Patent
Watanabe et al.

(10) Patent No.: US 9,643,411 B2
(45) Date of Patent: May 9, 2017

(54) POSITION DEVIATION ORDER DETECTION METHOD, IMAGE POSITION DEVIATION CORRECTION METHOD, STREAK UNEVENNESS CORRECTION TABLE CREATION METHOD, AND STREAK UNEVENNESS CORRECTION METHOD

(71) Applicant: FUJIFILM CORPORATION, Tokyo (JP)

(72) Inventors: Hiroki Watanabe, Kanagawa (JP); Tomohiro Mizuno, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/259,468

(22) Filed: Sep. 8, 2016

(65) Prior Publication Data

US 2016/0375681 A1 Dec. 29, 2016

Related U.S. Application Data

(63) Continuation of application No. PCT/JP2015/050344, filed on Jan. 8, 2015.

(30) Foreign Application Priority Data

Mar. 28, 2014 (JP) ..... 2014-069559

(51) Int. Cl.
*B41J 2/045* (2006.01)
*B41J 2/21* (2006.01)

(52) U.S. Cl.
CPC ..... *B41J 2/0456* (2013.01); *B41J 2/04586* (2013.01); *B41J 2/2135* (2013.01); (Continued)

(58) Field of Classification Search
CPC .... B41J 2/0456; B41J 2/04586; B41J 2/2135; B41J 2/2139; B41J 2/2142; B41J 2/2146
See application file for complete search history.

(56) References Cited

U.S. PATENT DOCUMENTS 6,504,625 B1 1/2003 Amero et al.
8,807,685 B2 * 8/2014 Ishida ..... B41J 2/2146 347/14

(Continued)

FOREIGN PATENT DOCUMENTS

EP 2062734 A1 5/2009
JP 2003-170645 A 6/2003

(Continued)

OTHER PUBLICATIONS

Written Opinion issued Mar. 23, 2015 in corresponding PCT Applicaiton No. PCT/JP2015/050344, 7pp.

(Continued)

*Primary Examiner* — Thinh H Nguyen
(74) *Attorney, Agent, or Firm* — Studebaker & Brackett PC

(57) ABSTRACT

A position deviation order detection method according to the invention calculates a difference between input image data of an original image used for printing an image using an inkjet printer and output image data acquired by reading the image using a scanner for each pixel, and compares the calculated difference with a first threshold value to extract pixels for which the difference is equal to or larger than the first threshold value, and detects the size of a position deviation of the image by the number of pixels of a closed pixel group among the extracted pixels.

14 Claims, 10 Drawing Sheets

(52) U.S. Cl.
CPC ..... *B41J 2/2139* (2013.01); *B41J 2/2142* (2013.01); *B41J 2/2146* (2013.01)

(56) References Cited

U.S. PATENT DOCUMENTS

| | | | | |
|---|---|---|---|---|
| 2004/0224102 | A1 | 11/2004 | Ebihara | |
| 2005/0001870 | A1 | 1/2005 | Komatsu | |
| 2006/0269342 | A1 | 11/2006 | Yoshida et al. | |
| 2009/0195580 | A1* | 8/2009 | Miyamoto ..... | B41J 2/04505 347/14 |

FOREIGN PATENT DOCUMENTS

| | | | |
|---|---|---|---|
| JP | 2004-330497 | A | 11/2004 |
| JP | 2005-088439 | A | 4/2005 |
| JP | 2006-305952 | A | 11/2006 |
| JP | 2007-268946 | A | 10/2007 |
| JP | 2012-066516 | A | 4/2012 |

OTHER PUBLICATIONS

International Search Report issued in PCT/JP2015/050344; mailed Apr. 7, 2015.

* cited by examiner

POSITION DEVIATION ORDER DETECTION METHOD, IMAGE POSITION DEVIATION CORRECTION METHOD, STREAK UNEVENNESS CORRECTION TABLE CREATION METHOD, AND STREAK UNEVENNESS CORRECTION METHOD

CROSS-REFERENCE TO RELATED APPLICATIONS

This application is a Continuation of PCT International Application No. PCT/JP2015/050344 filed on Jan. 8, 2015, which claims priority under 35 U.S.C. §119(a) to Japanese Patent Application No. 2014-069559 filed on Mar. 28, 2014. The above application is hereby expressly incorporated by reference, in its entirety, into the present application.

BACKGROUND OF THE INVENTION

1. Field of the Invention

The present invention relates to a position deviation order detection method, an image position deviation correction method, a streak unevenness correction table creation method, and a streak unevenness correction method, and more particularly, relates to a position deviation order detection method for detecting a position deviation of an image generated when the image is printed out by an inkjet printer in which plural inkjet heads are arranged in a sub scanning direction and is read using a scanner, an image position deviation correction method for correcting a position deviation of an image using a streak unevenness correction chart having a density image pattern corresponding to a size (order) of the position deviation of the detected image, a streak unevenness correction table creation method for creating a streak unevenness correction table for correcting streak unevenness generated in an image printed by an inkjet printer, and a streak unevenness correction method for correcting streak unevenness generated in an image using the created streak unevenness correction table.

2. Description of the Related Art

In recent years, a technique of printing a desired image on a recording medium such as soft packaging members made of PET or the like which are successively transported, by an inkjet printer using an elongated inkjet-type head, has been used. In the inkjet printer, density unevenness (density non-uniformity) occurs in a printed image due to variation of ejection characteristics of multiple ink ejection nozzles (printing elements) provided in inkjet heads, which causes problems in image quality.

In order to correct density unevenness, JP2012-066516A discloses a technique of outputting and measuring a density measurement test pattern using an inkjet printer to obtain a density unevenness correction value for each printing element, performing density unevenness correction using the density unevenness correction value for each printing element, and obtaining an image without density unevenness.

JP2012-066516A relating to a patent application of the applicant discloses a technique of printing out a density measurement test pattern including plural gradation values that vary in a sub scanning direction using an inkjet recording device, measuring the output density measurement test pattern, calculating a characteristic function for each recording element from measurement values and input gradation values used in printing, calculating a reference characteristic function from input measurement values obtained using an inverse function of the characteristic function and an average output gradation value, acquiring output measurement values as the input gradation values from an inverse function of the reference characteristic function, acquiring output gradation values from the inverse function of the characteristic function using the output measurement values as inputs, calculating the acquired output gradation values as unevenness correction values in the input gradation values, and performing unevenness correction so that differences between the input gradation values and the output gradation values are not generated.

On the other hand, JP2004-330497A discloses a technique relating to an inkjet printer having a characteristic print method based on an inkjet head and provided with an ejection head mounted on a carriage that reciprocates in a main scanning direction, in which when recording an image or the like by bidirectional printing (shuttle printing) in which an ink is ejected while the ejection head is reciprocating on a printing sheet transported in a sub scanning direction, a correction pattern having a density difference in the main scanning direction is formed in order to correct unevenness generated between a dot formation position on a forward path in the main scanning direction and a dot formation position on a return path in the main scanning direction, the density of the formed correction pattern is read, and the unevenness is corrected using the read density information. The disclosed correction pattern is a lattice pattern having a density difference in the main scanning direction.

SUMMARY OF THE INVENTION

However, in the technique disclosed in JP2012-066516A, with respect to streak unevenness generated when drawing an image using the inkjet head, a correction image formed by a density measurement test pattern is printed out, the output correction image is read using a scanner, and a correction table (LUT: lookup table) depending on ejection characteristics is created for each nozzle, and thus, it is possible to perform unevenness correction with high accuracy (streak unevenness correction) without a difference between the input gradation values and the output gradation values.

Here, in printing of a streak unevenness correction image using the inkjet head and scanning using the scanner, a position deviation (general or local rotation, parallel movement (distortion), or the like) may occur in a correction image which is finally read due to causes such as a printer head installation position error, a nozzle arrangement error, a scanner correction image installation position error, occurrence of wrinkles on an image due to an external force from the scanner, or the like.

However, in the technique disclosed in JP2012-066516A, since the position deviation of the correction image is not considered, the position deviation of the correction image is not corrected, and sufficient unevenness correction is not performed. That is, in a case where position deviation is not present in the correction image, it is possible to perform streak unevenness correction with high accuracy, but in a case where position deviation is present in the correction image, there is a concern that it may not be possible to accurately specify nozzles to be corrected according to ejection characteristics, corresponding to pixels which are targets of streak unevenness correction, which causes a difficulty in creating an accurate correction table for each nozzle. Thus, there is a concern that it is not possible to correct streak unevenness.

Further, in the density measurement test pattern disclosed in JP2012-066516A, since a specific density pattern (patch)

has a rectangular shape over an entire region in the main scanning direction, feature values characterizing the specific density pattern are only four corners (edges at four corners) with respect to each density pattern, a position deviation of an entire image or a position deviation corresponding to the size of one density pattern may be corrected. However, since there is not a density pattern corresponding to the size of a position deviation of an image, it is not possible to correct a local position deviation according to a position deviation of an entire image. As a result, the accuracy of the streak unevenness correction is lowered, and it is not possible to correct streak unevenness with high accuracy.

In the technique disclosed in JP2004-330497A, it is possible to correct a dot position deviation on the forward path and the return path in the main scanning direction specific to the bidirectional printing, but since the position deviation of the read correction pattern is not considered after printing, the position deviation of the correction pattern is not corrected, and thus, sufficient streak unevenness correction is not performed.

Further, although the position deviation of the correction pattern is detected and corrected using the density measurement test pattern disclosed in JP2004-330497A, since the test pattern is a correction pattern that superimposes a lattice-like pattern on the forward path and a lattice-like pattern on the return path to generate a density difference in the main scanning direction and the sizes of lattice cells are not uniform in the lattice-like pattern, it is difficult to detect and correct the position deviation of the correction pattern.

In addition, although the position deviation of the lattice-like pattern is detected and corrected using the lattice-like pattern image formed on the return path, since the lattice-like pattern is not a lattice-like pattern depending on the size of a position deviation of an image, it is not possible to correct a local position deviation depending on the position deviation of the entire lattice-like pattern image. As a result, the accuracy of streak unevenness correction is lowered, and it is not possible to correct streak unevenness with high accuracy.

In order to solve the above-mentioned problems in the related art, an object of the invention is to provide a position deviation order detection method capable of detecting, in a case where occurrence of a position deviation is assumed in a correction image, the size (size within a position deviation order) of the assumed position deviation (or a position deviation amount), an image position deviation correction method capable of accurately and efficiently correcting detected position deviations of various sizes by forming appropriate density image patterns depending on orders or sizes thereof and using the density image patterns as correction images, a streak unevenness correction table creation method capable of correcting a position deviation to eliminate a position deviation of a correction image and capable of accurately and efficiently creating a correction table, and a streak unevenness correction method capable of accurately and efficiently correcting streak unevenness generated in an image using the created streak unevenness correction table.

According to an aspect of the invention, there is provided a position deviation order detection method for detecting, in order to determine a streak unevenness correction chart that has a size corresponding to the size of a position deviation of an image generated when the image printed by an inkjet printer is read using a scanner and includes a density image pattern formed by a plurality of units for correcting the position deviation of the image, the size of the position deviation of the image, the method comprising: calculating a difference between input image data of an original image used for printing the image by the inkjet printer and output image data obtained by reading the image using the scanner for each pixel; comparing the calculated difference with a first threshold value and extracting pixels for which the difference is equal to or larger than the first threshold value; and detecting the size of the position deviation of the image according to the number of pixels of a pixel group that forms a closed figure among the extracted pixels.

Here, it is preferable that where the difference is calculated for each of R, G, and B data, the RGB data are represented as 256 gradations with 8 bits, and the first threshold value is represented by ⅓ (86 gradations) of the 256 gradations, pixels for which a maximum value of the differences of the R, G, and B data or the difference of the G data exceeds the first threshold value are extracted, and the size of the position deviation of the image is determined according to each number of pixels of a plurality of pixel groups that is present on a whole of the image.

Further, it is preferable that where 90% or more of the plurality of pixel groups are formed by one to ten pixels, it is determined that the size of the position deviation of the image is within a pixel size order.

Further, it is preferable that where the inkjet printer includes a plurality of inkjet heads arranged in a main scanning direction and 90% or more of the plurality of pixel groups are formed by pixels of which the number is 0.8 to 1.2 times the number of pixels that form the inkjet heads, it is determined that the size of the position deviation of the image is within a head size order.

Further, it is preferable that where the inkjet printer includes a plurality of inkjet heads arranged in a main scanning direction and 90% or more of the plurality of pixel groups are formed by pixels of which the number is larger than 1.2 times the number of pixels that form the inkjet heads and is equal to or smaller than a larger one of the number of longitudinal pixels and the number of transverse pixels in an image size, it is determined that the size of the position deviation of the image is within an image size order.

Further, it is preferable that where the pixel group that forms the closed figure among the extracted pixels does not satisfy requirements for the number of pixels regulated by the above-described position deviation order detection method, it is determined that the size of the position deviation of the image is a mixed size having sizes within at least two of the pixel size order, the head size order, and the image size order.

According to another aspect of the invention, there is provided an image position deviation correction method comprising: detecting the size of the position deviation of the image by the above-described position deviation order detection method; selecting a streak unevenness correction chart that includes a density image pattern formed by a plurality of units having a size corresponding to the size of the position deviation of the image; printing the streak unevenness correction chart by the inkjet printer using the input image data for printing the selected streak unevenness correction chart; reading the printed streak unevenness correction chart using the scanner to obtain output image data of a printed image of the streak unevenness correction chart read by the scanner; and correcting the position deviation included in the output image data using the input image data and a feature value of each unit.

Here, it is preferable that the density image pattern of the streak unevenness correction chart includes a plurality of unit arrays which are arranged at a first interval in a sub scanning direction orthogonal to the main scanning direction, each unit array includes a plurality of units that has a size corresponding to the size of the position deviation of the image and is arranged at a second interval in the main direction, each of the plurality of unit arrays includes a plurality of unit groups that includes two unit arrays which are adjacent to each other in the sub scanning direction and has different densities, and the plurality of units included in each unit group has the same density.

Further, it is preferable that the feature value of the unit includes at least one of edges, corners, and the center of gravity of the unit, and the correction of the position deviation is performed by affine-converting the output image data of the printed image of the streak unevenness correction chart using the input image data of the streak unevenness correction chart and the feature value of the unit.

Further, it is preferable that the image position deviation correction method further comprises: calculating, from image data of an image obtained by reading the image printed by the inkjet printer using the scanner, the degree of an optical dot gain that is generated in a contour portion of a pattern in the read image; comparing the calculated degree of the optical dot gain with a second threshold value to determine that the optical dot gain of which the degree is equal to or larger than the second threshold value is to be taken into account; and selecting the streak unevenness correction table according to the optical dot gain determined to be taken into account and the size of the position deviation of the image.

Further, it is preferable that the image position deviation correction method further comprises: calculating an L* value, an a* value and a b* value, in an L*a*b* standard color space, of a portion where the optical dot gain of the contour portion of the pattern in the read image is generated, and an L* value, an a* value and a b* value of a non-printed portion; calculating a color difference ΔE from the calculated L*a*b* values of the portion where the optical dot gain is generated and the L*a*b* values of the non-printed portion; and setting the calculated color difference ΔE as the degree of the optical dot gain, setting the second threshold value to 0.8, and determining that the optical dot gain for which the color difference ΔE is equal to or larger than 0.8 is an optical dot gain to be taken into account.

According to still another aspect of the invention, there is provided a streak unevenness correction table creation method comprising: correcting a position deviation included in the output image data of the printed image of the streak unevenness correction chart using the above-described image position deviation correction method; and creating a correction table for correcting a streak unevenness that is generated in an image output from the inkjet printer for each of a plurality of ink ejection nozzles of a plurality of inkjet heads of the inkjet printer, using the output image data in which the position deviation is corrected and the input image data of the streak unevenness correction chart.

Further, it is preferable that the correction table is a lookup table indicating a relationship between a signal value applied to each ink ejection nozzle and the density of a dot formed by an ink ejected from the ink ejection nozzle.

According to yet still another aspect of the invention, there is provided a streak unevenness correction method comprising: adjusting signal values applied to the plurality of ink ejection nozzles of the plurality of inkjet heads of the inkjet printer using the correction table created by the above-described streak unevenness correction table creation method; and forming an image in which streak unevenness is corrected using the adjusted signal values.

According to the invention, in a case where occurrence of a position deviation is assumed in a correction image, it is possible to detect the size (size within a position deviation order) of the assumed position deviation (or a position deviation amount).

Further, according to the invention, it is possible to accurately and efficiently correct detected position deviations of various sizes by forming appropriate density image patterns depending on orders or sizes thereof and using the density image patterns as correction images.

Furthermore, according to the invention, it is possible to correct a position deviation to eliminate a position deviation of a correction image, and to accurately and efficiently create a correction table.

In addition, according to the invention, it is possible to accurately and efficiently correct streak unevenness generated in an image using a created streak unevenness correction table.

DESCRIPTION OF THE PREFERRED EMBODIMENTS

Hereinafter, a position deviation order detection method, an image position deviation correction method, a streak unevenness correction table creation method, and a streak unevenness correction method, according to the invention, will be described in detail with reference to preferable embodiments shown in the accompanying drawings.

Figure 1:
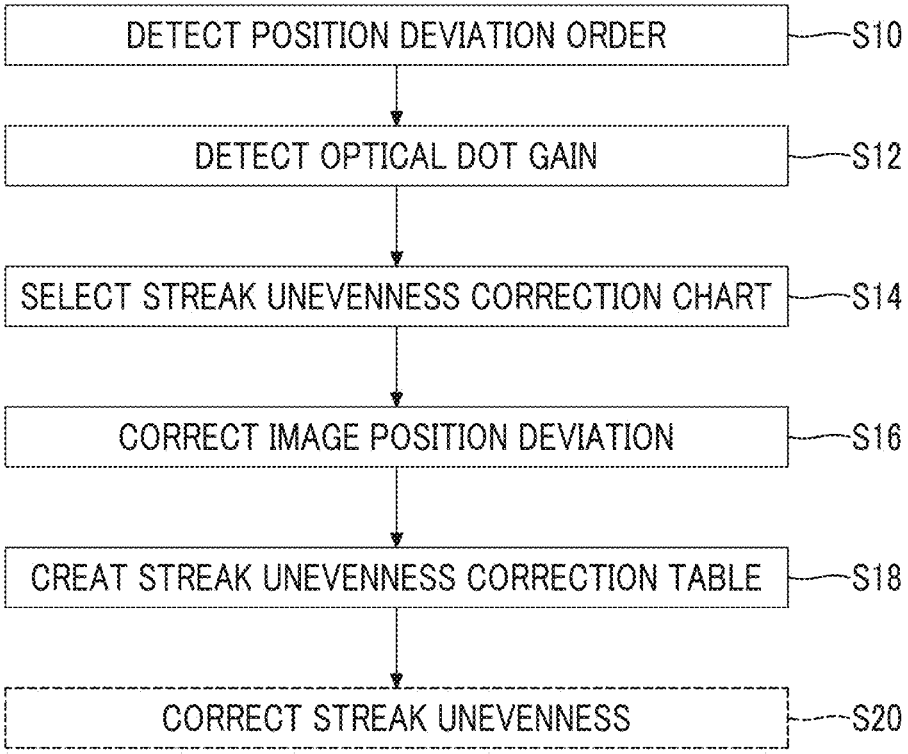
FIG. 1 is a flowchart illustrating an example of a streak unevenness correction table creation method and a streak unevenness correction method according to an embodiment of the invention.

FIG. 1 is a flowchart illustrating an example of a streak unevenness correction table creation method and a streak unevenness correction method, according to an embodiment of the invention.

First, in step S10, the size (order) of a position deviation of an image output from an inkjet printer including plural inkjet heads arranged in a main scanning direction is detected.

Here, the size (size order) of the position deviation of the image detected in step S10 includes sizes within at least four position deviation size orders, that is, sizes within three position deviation size orders of a pixel size order approximately corresponding to several pixels, a head size order approximately corresponding to an inkjet head size, and an image size order approximately corresponding to an image size, and at least one of sizes within plural size-mixed position deviation orders including at least two size orders of the above-mentioned three size orders.

Details about the position deviation size orders will be described later.

Then, in step S12, an optical dot gain is detected from an image formed on a recording medium such as a soft packing member, output from the inkjet printer.

Here, the recording medium on which an image is formed by dots based on an ink ejected from ejection nozzles of the inkjet printer is not particularly limited, but a sheet-like paper, a film-like paper, a plate-like paper, or a belt-like (web-like) paper, resin or the like may be used. Here, it is preferable that the recording medium is used as a packaging member or the like. In a case where the optical dot gain is considered, it is preferable that a packaging member made of resin, particularly, a resin film containing at least one component selected from a group consisting of polyethylene terephthalate, polypropylene, polypropylene, and nylon is used.

Then, in step S14, a streak unevenness correction chart that has a density image pattern including plural units for creating a streak unevenness correction table according to the position deviation size order of the image detected in step S10 and the optical dot gain detected in step S12 is determined or selected.

Although details will be described later, in determination of the streak unevenness correction chart, in a case where the position deviation size order of the image corresponds to the pixel size order, the head size order, the image size order, and the size-mixed position deviation order, streak unevenness correction charts 10, 30, 50, and 70 in which position deviation size orders of images are different from each other, shown in FIGS. 2A, 3A, 4A, and 5A, respectively are selected. Further, in a case where the optical dot gain is detected, streak unevenness correction charts 20, 40, and 60 in which position deviation size orders of images are different from each other shown in FIGS. 2B, 3B, and 4B, and a streak unevenness correction chart corresponding to the size-mixed position deviation order are selected.

Then, in step S16, the streak unevenness correction chart selected in step S14 is printed out using the inkjet printer, an output print image is read using a scanner, output image data is acquired, and the output image data is affine-converted using input image data for printing the streak unevenness correction chart and feature values (edges, the center of gravity, corners or the like) of the units of the streak unevenness correction chart, so that a position deviation of the print image is corrected.

Then, in step S18, using the input image data used for printing the streak unevenness correction chart in step S16 and output image data of the streak unevenness correction chart in which the position deviation is corrected, a streak unevenness correction table (LUT: lookup table) for correcting streak unevenness generated in an image printed by the inkjet printer is created for each of plural ink ejection nozzles of the plural inkjet heads of the inkjet printer.

Hence, the streak unevenness correction table creation method according to the invention is terminated.

Then, in step S20, using the streak unevenness correction table created in step S18, signal values to be applied to the plural ink ejection nozzles of the plural inkjet heads of the inkjet printer are adjusted, an ink of an amount which is appropriately adjusted using the ink ejection nozzles to which the adjusted signal values are applied is ejected onto the recording medium of the soft packaging member or the like, so that dots (for example, pixels) of which the concentration is appropriately adjusted are formed to form an image without streak unevenness for which the streak unevenness is corrected.

Hence, the streak unevenness correction method according to the invention is terminated.

The streak unevenness correction chart used in the above-described streak unevenness correction table creation method of the invention includes at least four position deviation correspondence streak unevenness correction charts, that is, three types of position deviation correspondence streak unevenness correction charts of a pixel size position deviation correspondence streak unevenness correction chart, a head size position deviation correspondence streak unevenness correction chart, and a image size position deviation correspondence streak unevenness correction chart which are respectively associated with position deviations of an image of the pixel size order, the head size order, and the image size order detected in step S10, and at least one of size-mixed position deviation correspondence streak unevenness correction charts which are associated with images of plural size-mixed position streak unevenness orders including at least two of the three types of position deviations.

Figure 2C:
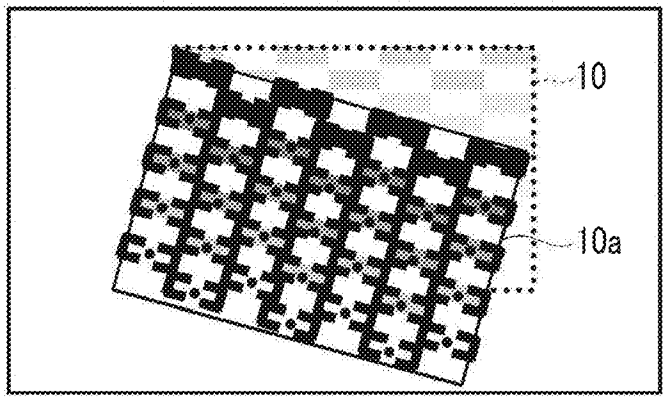
FIG. 2C is a plan view schematically illustrating an embodiment of the streak unevenness correction chart shown in FIG. 2A.
Figure 2D:
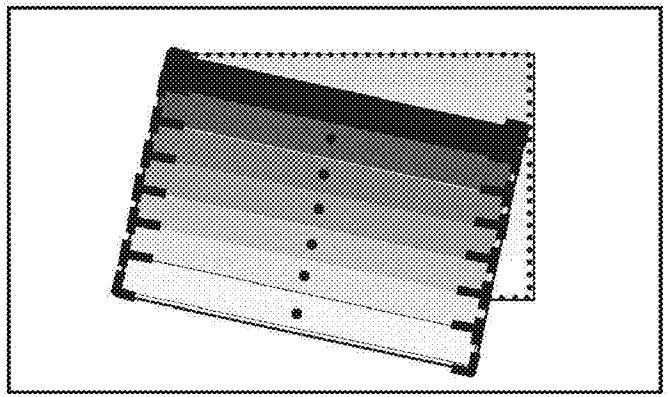
FIG. 2D is a plan view schematically illustrating an embodiment of a streak unevenness correction chart in the related art.
Figure 2A:
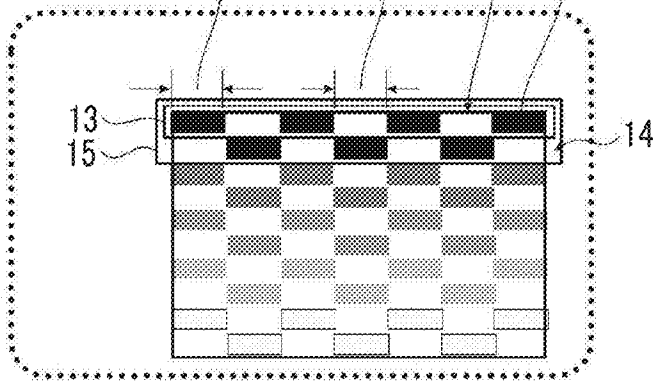
FIGS. 2A and 2B are plan views schematically illustrating an example of streak unevenness correction charts which are respectively used in the invention.
Figure 2B:
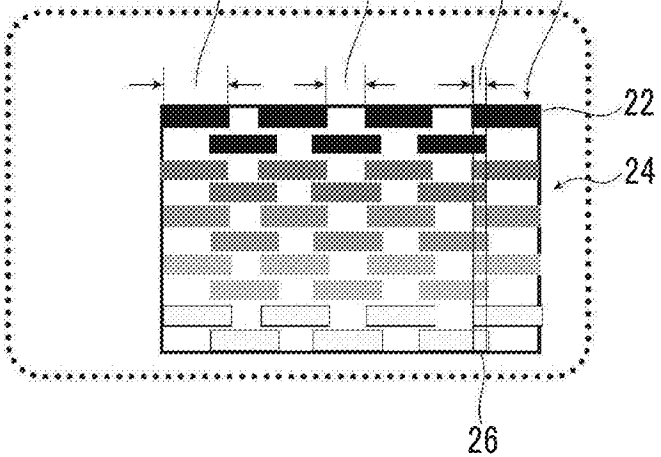
Figure 3C:
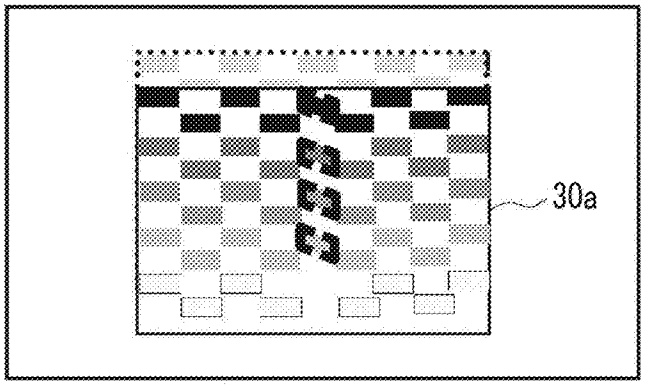
FIG. 3C is a plan view schematically illustrating an embodiment of the streak unevenness correction chart shown in FIG. 3A.
Figure 3D:
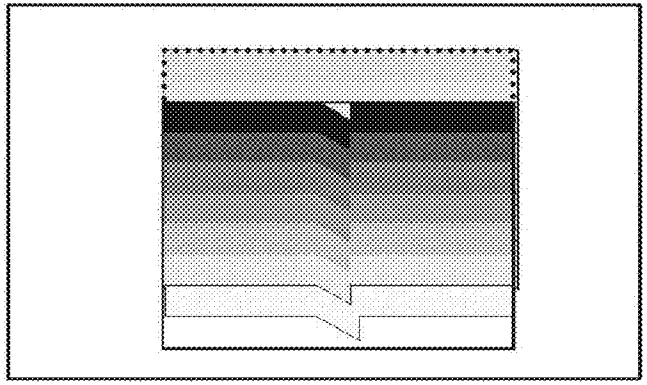
FIG. 3D is a plan view schematically illustrating an embodiment of a streak unevenness correction chart in the related art.
Figure 3A:
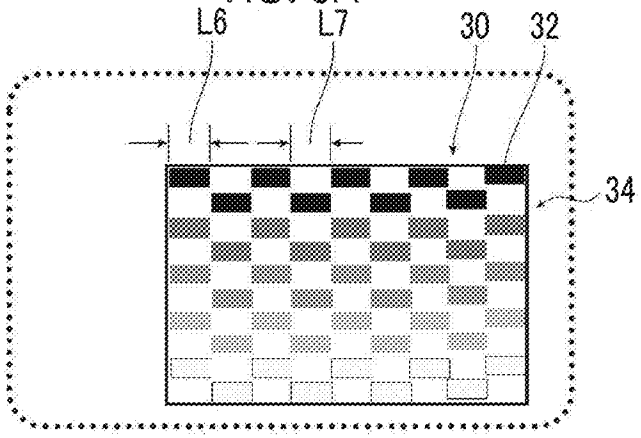
FIGS. 3A and 3B are plan views schematically illustrating another example of streak unevenness correction charts which are respectively used in the invention.
Figure 3B:
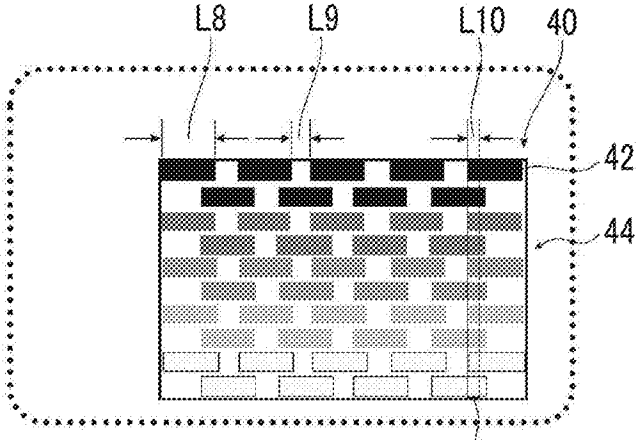
Figure 4C:
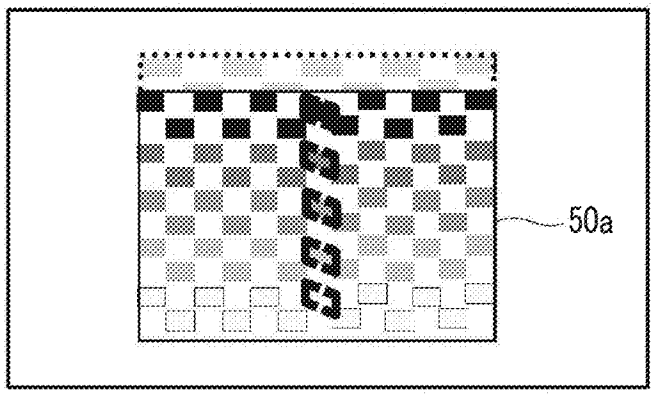
FIG. 4C is a plan view schematically illustrating an embodiment of the streak unevenness correction chart shown in FIG. 4A.
Figure 4D:
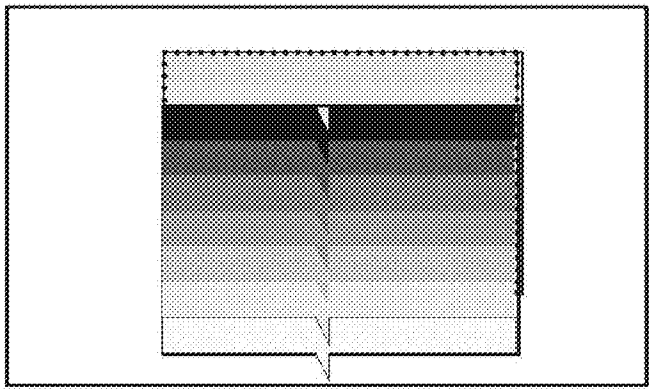
FIG. 4D is a plan view schematically illustrating an embodiment of a streak unevenness correction chart in the related art.
Figure 4A:
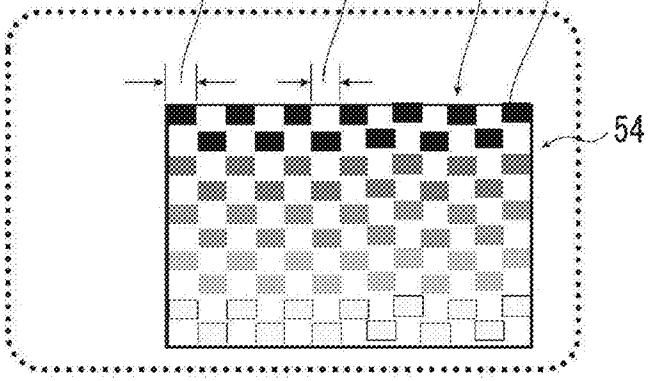
FIGS. 4A and 4B are plan views schematically illustrating another example of streak unevenness correction charts which are respectively used in the invention.
Figure 4B:
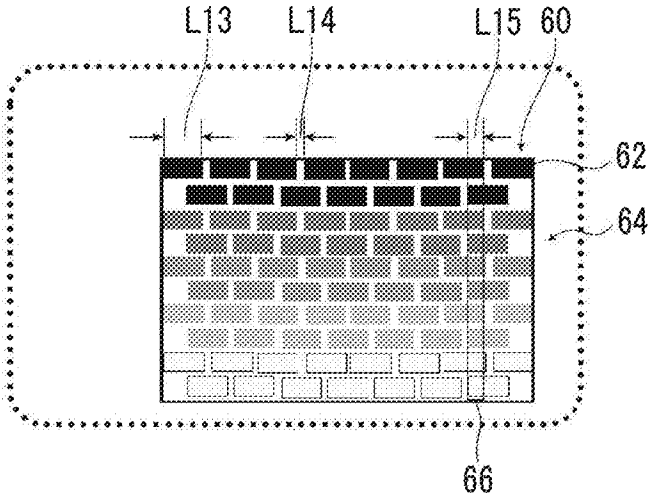

Here, FIGS. 2A, 3A, 4A, and 5A show streak unevenness correction charts in which position deviation size orders of images are different from each other, and FIGS. 2B, 3B, and 4B show streak unevenness correction charts in which position deviation size orders of images used in a case where the detected optical dot gain is not ignorable are different from each other.

The image size position deviation correspondence streak unevenness correction chart (hereinafter, referred to as an image size chart) 10 which is associated with a position deviation of an image of an image size order shown in FIG. 2A includes an arrangement of plural rectangular units 12 of a size L1 corresponding to the size of the position deviation of the image of the image size order, which is a density image pattern (streak unevenness correction LUT creation input image pattern) 14 formed in a checkered pattern (checkered flag) in the shown example. Here, as long as the shape of the unit 12 has suitable feature values such as edges, the center of gravity, or corners used for position deviation correction, the shape of the unit 12 may have any shape. For example, instead of the rectangle, a quadrangle including a square or the like, a lattice or the like may be preferably used.

Here, it is preferable that the size L1 of the unit 12 of the density image pattern 14 of the image size chart 10 in which the size of the position deviation is the image size order is a size which is larger than 1.2 times the head size of the inkjet head and is equal or smaller than a larger one of the number of longitudinal pixels and the number of transverse pixels in an image size.

The density image pattern 14 has a configuration in which plural unit arrays 13 which are respectively formed by plural units 12 arranged in a main scanning direction which is a horizontal direction in FIG. 2A at a predetermined interval L2 and having a predetermined density are arranged in a sub scanning direction at a predetermined interval.

Here, it is preferable that the size (length in the main scanning direction) L1 of each of the units 12 that form the unit array 13 is equal to an interval L2 of two adjacent units 12 in the main scanning direction, and that the adjacent units 12 are arranged so as not to have an overlap in the main scanning direction when seen from the sub scanning direction.

Further, in the plural unit arrays 13, two unit arrays 13 which are adjacent to each other in the sub scanning direction (vertical direction in FIG. 2A) orthogonal to the main scanning direction are arranged in a state where the plural units 12 that form the respective unit arrays 13 deviate from each other in the main scanning direction by a half-pitch, that is, have a phase difference of the half-pitch. That is, in the density image pattern 14, the plural units 12 are arranged in a checkered pattern.

Further, in the shown example, all the units 12 of an odd-numbered unit array 13 and an even-numbered unit array 13 form an identical density unit group 15 having the same density.

Accordingly, the density image pattern 14 includes plural identical density unit groups 15 arranged in the sub scanning direction, and the respective units 12 that form the plural identical density unit groups 15 have different densities. In the shown example, the identical density unit groups 15 are arranged so that the density becomes low from above to below.

Since the image size chart 20 associated with a position deviation of an image of an image size order shown in FIG. 2B has the same configuration as that of the image size chart 10 shown in FIG. 2A except that a size L3 of a unit 22 in the main scanning direction that forms a density image pattern 24 is longer than the size L1 of the unit 12 in the main scanning direction that forms the density image pattern 14 of the image size chart 10, and accordingly, an interval L4 between two adjacent units 22 in the main scanning direction is shorter than the interval L2 between two adjacent units 12, and an overlap portion 26 of a size (length) L5 is formed in end portions of the units 22 arranged in the sub scanning direction, description about the same configuration will not be repeated.

When an optical dot gain is generated in a contour portion of a pattern a read image obtained by reading an image formed on a recording medium such as a soft packaging member using a scanner since the image size chart 20 includes the density image pattern 24 where the units 22 include the overlap portion 26, the image size chart 20 calculates the degree of the optical dot gain, and functions as an optical dot gain correspondence pattern for eliminating the influence of the optical dot gain.

Although details will be described later, in a case where the optical dot gain is detected, a reason for selecting the image size chart 20 including the density image pattern 24 in which the overlap portion 26 is provided is as follows. At a pixel (see point A in FIG. 8 which will be described later) of a contour portion of the unit (lattice) 12, an image is blurred, so that a density signal value is not accurate. On the other hand, at an inner pixel (see point B in FIG. 8) of the unit (lattice) 12 separated from the contour portion, image blurring does not occur. Accordingly, if a density signal value of the inner pixel is used instead of the density signal value of the pixel in the contour portion, the accuracy is not lowered.

FIG. 2C shows a plan view of an image size chart 10*a* in a state where the image size chart 10 is rotated by a predetermined angle from an original position as a whole.

On the other hand, FIG. 2D shows a state where plural patches of a full line size (entire length of a print head) in a main scanning direction are provided in the related art and densities of the plural patches vary. This example shows a state where a streak unevenness correction chart of which the density becomes thin from above to below is similarly rotated by a predetermined angle from an original position as a whole.

Since the image size chart 10 (10*a*) used in the invention shown in FIG. 2C includes a larger number of units 12 compared with the number of patches in the streak unevenness correction chart in the related art shown in FIG. 2D, the number of feature values such as edges or the centers of gravity of the units 12 of the image size chart 10 (10*a*) used in the invention is extremely large compared with the number of feature values such as edges or the centers of gravity of the patches of the streak unevenness correction chart in the related art. Thus, by returning the image size chart 10*a* to the image size chart 10 at the original position through affine-conversion or the like, using the feature values of the multiple units 12 it is possible to correct a position deviation of an image.

In this way, in a case where the image size chart 10 is used in the invention, since it is possible to increase the number of units 12, it is possible to use the centers of gravity as the feature values of the units 12, but it is preferable to use multiple edges instead of the centers of gravity.

For example, where a feature value (edges or the center of gravity) of the unit 12 of the rotated image size chart 10*a* is represented as (Xi, Yi) (i=1 to n) and a feature value (edges or the center of gravity) of the unit 12 of the image size chart 10 is represented as (xi, yi) (i=1 to n), by calculating a point (Xi, Yi) on the image size chart 10*a* corresponding to a point (xi, yi) on the image size chart 10, calculating coefficients a, b, c, d, e, and f in the following Expression (1), and converting an arbitrary point (X, Y) on the image size chart 10*a* into a point (x, y) on the image size chart 10 using Expression (1), based on image data (output image data that is output from an inkjet printer and is read using a scanner) of the image size chart 10*a* and image data (input image data that is input to the inkjet printer) of the image size chart 10, it is possible to obtain output image data with a position deviation being corrected.

$$x=aX+bY+c$$

$$y=dX+eY+f \quad (1)$$

Thus, in a case where the image size chart 10 or 20 is used in the invention, t is possible to correct a local position deviation, distortion or the like, in addition to deviation of an entire image (deformation such as rotation or parallel movement), which has not been easily handled by the streak unevenness correction chart in the related art.

The head size position deviation correspondence streak unevenness correction chart (hereinafter, referred to as a head size chart) 30 which is associated with a position deviation of an image of a head size order shown in FIG. 3A includes a density image pattern 34 formed by an arrangement of plural rectangular units 32 of a size L6 corresponding to the size of the position deviation of the image of the head size order.

Here, it is preferable that the size L6 of the unit 32 of the density image pattern 34 of the head size chart 30 in which the size of the position deviation is the head size order of the inkjet head is a size of 0.8 times to 1.2 times the head size of the inkjet head.

Since the head size chart 30 shown in FIG. 3A has the same configuration as in the image size chart 10 shown in FIG. 2A except that the size L6 of the unit 32 that forms the density image pattern 34 in the main scanning direction is shorter than the size L1 of the unit 12 that forms the density image pattern 14 of the image size chart 10 in the main scanning direction and an interval L7 between two units 32 which are adjacent to each other in the main scanning direction is also shorter than the interval L2 between two adjacent units 12, description about the same configuration will not be repeated.

In the head size chart 30, similar to the image size chart 10, it is preferable that the units 32 are arranged so that the size L6 of the unit 32 is equal to the interval L7 between the units 32 and the units 32 which are adjacent to each other in the sub scanning direction do not overlap each other.

Further, the head size chart 40 associated with a position deviation of an image of a head size order shown in FIG. 3B, also functions, in a case where an optical dot gain is detected, as an optical dot vain correspondence pattern for eliminating the influence of the optical dot gain, similar to the image size chart 20 shown in FIG. 2B. Further, the head size chart 40 has the same configuration as that of the head size chart 30 shown in FIG. 3A except that a size L8 of a unit 42 that forms a density image pattern 44 in the main scanning direction is shorter than the size L6 of the unit 32 that forms the density image pattern 34 of the head size chart 30 in the main scanning direction, and accordingly, an interval L9 between two units 42 which are adjacent to each other in the main scanning direction is shorter than the interval L7 between two adjacent units 32 and an overlap portion 46 of a size (length) L10 is formed in end portions of the units 42 arranged in the sub scanning direction, and thus, description about the same configuration will not be repeated.

FIG. 3C shows a plan view of a head size chart 30*a* in a state where a position deviation such as deformation of the head size order locally occurs in a long region (for example, in a whole region) of a central portion of the head size chart 30 in the sub scanning direction, from an original position.

On the other hand, FIG. 3D shows a state where a position deviation such as deformation of a head size order locally occurs in a long region (for example, in a whole region) of a central portion of the streak unevenness correction chart in the sub scanning direction, from an original position.

Since the head size chart 30*a* used in the invention shown in FIG. 3C includes a larger number of units 32 compared with the number of patches in the streak unevenness correction chart in the related art shown in FIG. 3D, the number of feature values of the units 32 of the image size chart 30*a* used in the invention is extremely large compared with the number of feature values such as edges or the centers of gravity included in the patches of the streak unevenness correction chart in the related art. Thus, it is possible to return the image size chart 30*a* to the original position using the feature values of the multiple units 32 and using Expression (1) or the like through affine-conversion or the like, to correct a position deviation of an image. In a case where the image size chart 30 or 40 is used in the invention, since the number of units 32 increases but the size of the position deviation of the head size order decreases, it is preferable to use edges as the feature values of the units 32.

Thus, in a case where the image size chart 30 or 40 is used in the invention, it is possible to accurately correct a position deviation or deformation of a head size order, which has not been easily handled by the streak unevenness correction chart in the related art.

The pixel size position deviation correspondence streak unevenness correction chart (hereinafter, referred to as a pixel size chart) 50 which is associated with a position deviation of an image of a pixel size order shown in FIG. 4A includes a density image pattern 54 formed by an arrangement of plural rectangular units 52 of a size L11 corresponding to the size of the position deviation of the image of the pixel size order.

Here, it is preferable that the size L11 of the unit 52 of the density image pattern 54 of the pixel size chart 50 in which the size of the position deviation is the pixel size order of the inkjet head is larger than 1 to 10 times the pixel size of the inkjet head.

The pixel size chart 50 shown in FIG. 4A has the same configuration as that of the head size chart 30 shown in FIG. 3A except that a size L11 of a unit 52 that forms a density image pattern 54 in the main scanning direction is shorter than the size L6 of the unit 32 that forms the density image pattern 34 of the head size chart 30 in the main scanning direction and an interval L12 between two units 52 which are adjacent to each other in the main scanning direction is shorter than the interval L7 between two adjacent units 32, and thus, description about the same configuration will not be repeated.

In the pixel size chart 50, similar to the head size chart 30, it is preferable that the size L11 of each of the unit 52 is equal to the interval L12 between the units 52 and the adjacent units 52 are arranged so as not to have an overlap in the sub scanning direction.

Further, the pixel size chart 60 associated with a position deviation of an image of a pixel size order shown in FIG. 4B also functions, in a case where an optical dot gain is detected, as an optical dot gain correspondence pattern for eliminating the influence of the optical dot gain, similar to the image size chart 40 shown in FIG. 3B. Further, the pixel size chart 60 has the same configuration as that of the pixel size chart 50 shown in FIG. 4A except that a size L13 of a unit 52 that forms a density image pattern 54 in the main scanning direction is longer than the size L11 of the unit 52 that forms the density image pattern 54 of the pixel size chart 50 in the main scanning direction, and accordingly, an interval L14 between two units 62 which are adjacent to each other in the main scanning direction is shorter than the interval L12 between two adjacent units 52 and an overlap portion 66 of a size (length) L15 is formed in end portions of the units 62 arranged in the sub scanning direction, and thus, description about the same configuration will not be repeated.

FIG. 4C shows a plan view of an image size chart 50*a* in a state where a position deviation such as distortion of a pixel size order locally occurs in a long region (for example, in a whole region) of a central portion of the pixel size chart 50 in the sub scanning direction, from an original position.

On the other hand, FIG. 4D shows a state where a position deviation such as deformation of the pixel size order locally occurs in a long region (for example, in a whole region) of a central portion of a streak unevenness correction chart in the sub scanning direction, from an original position.

Since the image size chart 50*a* used in the invention shown in FIG. 4C includes a larger number of units 52 compared with the number of patches in the streak unevenness correction chart in the related art shown in FIG. 4D, the number of feature values of the unit 52 of the image size chart 50*a* used in the invention is extremely large compared with the number of feature values such as edges or the centers of gravity of the patches of the streak unevenness correction chart in the related art. Thus, by returning the image size chart 50*a* at the original position through affine-conversion or the like, for example, using Expression (1), and using the feature values of the multiple units 52, it is possible to correct a position deviation of an image. In a case where the image size chart 50 or 60 is used in the invention, since the number of units 52 increases but the size of a position deviation of the pixel size order decreases, it is preferable to use edges as the feature values of the units 52.

Thus, in a case where the image size chart 50 or 60 is used in the invention, it is possible to accurately correct a position deviation, distortion or the like of a pixel size order, which has not been easily handled by the streak unevenness correction chart in the related art.

The size-mixed position deviation correspondence streak unevenness correction chart (hereinafter, referred to as a size-mixed chart) 70 which is associated with a position deviation of an image of plural size-mixed position deviation orders including three types of position deviations of a pixel size order, a head size order, and an image size order shown in FIG. 5A includes a density image pattern 74 formed by an arrangement of plural rectangular size-mixed units 72 of the size L1 corresponding to the size of the position deviation of the image of the image size order, similar to the image size chart 10.

Here, the size-mixed unit 72 has the same size L1 as that of the unit 12 of the image size chart 10, and includes a part (small portion) of the same density image pattern as the density image pattern 34 in which plural assembly units 76 having the same size L6 as that of the unit 32 of the head size chart 30 are in a checkered pattern.

Further, the assembly unit 76 has the same size L6 as that of the unit 32 of the head size chart 30, and includes a part (small portion) of the density image pattern 54 in which plural units 78 having the same size L11 as that of the pixel size chart 50 are arranged in a checkered pattern.

Figure 5A:
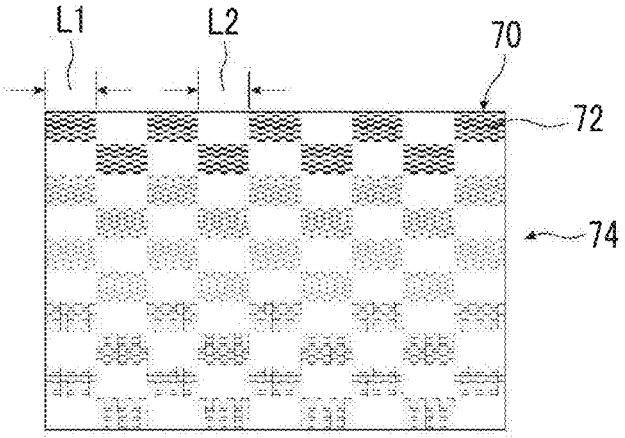
FIG. 5A is a plan view schematically illustrating another example of streak unevenness correction charts used in the invention.
Figure 5B:
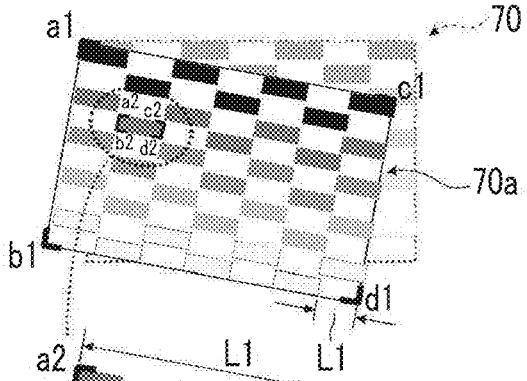
FIG. 5B is a plan view schematically illustrating an embodiment of the streak unevenness correction chart shown in FIG. 5A.

Here, as shown in FIG. 5B, where the size-mixed chart 70 rotates by a predetermined angle from an original position as a whole to be in a state of an image size chart 70*a*, four apexes of the rectangular image size chart 70*a* are represented as a1, b1, c1, and d1, and four apexes of the rectangular size-mixed unit 72 that forms the image size chart 70*a* are represented as a2, b2, c2, and d2.

Figure 5C:
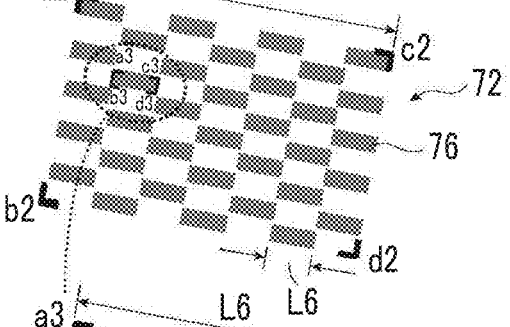
FIG. 5C is a plan view schematically illustrating a configuration of units that form the streak unevenness correction chart in the embodiment shown in FIG. 5B.

As shown in FIG. 5C, the rectangular size-mixed unit 72 of which the four apexes are represented as a2, b2, c2, and d2 has the same size L1 as that of the unit 12 of the image size chart 10, and is a density image pattern in which plural rectangular units 76 of which four apexes are represented as a3, b3, c3, and d3, having the same size L6 as that of the unit 32 of the head size chart 30, are arranged in a checkered pattern, in which the density image pattern having the same size L1 as that of the unit 12 of the image size chart 10 is the same pattern as the density image pattern 34.

Figure 5D:
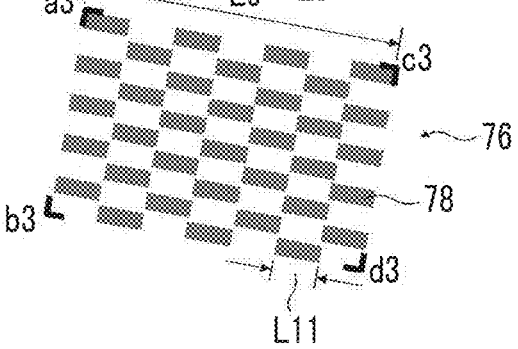
FIG. 5D is a plan view schematically illustrating small-sized units that form the units of the streak unevenness correction chart in the embodiment shown in FIG. 5C.

As shown in FIG. 5D, the rectangular assembly unit 76 of which the four apexes are represented as a3, b3, c3, and d3 has the same size L6 as that of the unit 32 of the head size chart 30, and is a density image pattern in which plural rectangular units 78 having the same size L11 as that of the unit 52 of the image size chart 50, are arranged in a checkered pattern, in which the density image pattern having the same size L1 as that of the unit 12 of the image size chart 10 is the same pattern as the density image pattern 34.

Since the mixed unit 72 which is a component of the mixed chart 70 shown in FIG. 5A may be considered as the same unit as the unit 12 of the image size chart 10, the mixed chart 70 shown in FIG. 5A may be considered as the same chart as the image size chart 10.

Further, since the assembly unit 76 which is a component of the mixed unit 72 shown in FIG. 5C may be considered as the same unit as the unit 32 of the head size chart 30, the mixed unit 72 shown in FIG. 5C may be considered as the same chart as the head size chart 30.

Furthermore, since the assembly unit 76 shown in FIG. 5D may be considered as the same unit as the unit 78 which is a component of the assembly unit 76 and the unit 52 of the pixel size chart 50, the assembly unit 76 shown in FIG. 5D may be considered as the same chart as the pixel size chart 50.

Although not shown, in a case where the size-mixed chart 70 has a function as a optical dot gain correspondence pattern, the size L11 and the interval L12 of the units 78 that form the assembly unit 76 shown in FIG. 5D may be respectively set to a size L13 and an interval L14 of the units 62 of the pixel size chart 60. Thus, it is possible to provide an overlap portion in end portions of the units 78 in the sub scanning direction, and to set its size to L15.

Thus, where three types of position deviations of the pixel size order, the head size order, and the image size order are corrected using the size-mixed chart 70, first, using input image data of the size-mixed chart 70 and using the center of gravity or edges as a feature value of the mixed unit 72, a position deviation of an image size order of output image data of the size-mixed chart 70 is corrected.

Then, using the size-mixed unit 72 of the size-mixed chart 70 as the head size chart 30, and using the input image data and the edges which are the feature values of the assembly unit 76, a position deviation of a head size order of output image data with the position deviation of the image size order being corrected is corrected.

Subsequently, using the assembly unit 76 in the mixed unit 72 of the size-mixed chart 70 as the pixel size chart 50, and using the input image data and the edges which are the feature values of the unit 78, a position deviation of a pixel size order of output image data with the position deviation of the head size order being corrected is corrected.

In the correction of three types of position deviations of the pixel size order, the head size order, and the image size order, Expression (1) may be used as described above.

In this way, it is possible to correct three types of position deviations of the pixel size order, the head size order, and the image size order using the size-mixed chart 70.

The size-mixed chart 70 shown in FIGS. 5A to 5D is a chart for correcting the three types of position deviations of the pixel size order, the head size order, and the image size order, but the invention is not limited thereto. Two of the three types of position deviations may be corrected.

Such a size-mixed chart may be obtained by forming large-sized units using density image patterns in which small sized units are arranged in a checkered pattern, as units corresponding to position deviations of two types of size orders.

That is, a density image pattern is formed as a size-mixed position deviation correspondence density image pattern corresponding to plural position deviations having different sizes, respectively, in which a small-sized position deviation correspondence density image pattern is formed by small-sized units corresponding to a small-sized position deviation and a large-sized position deviation correspondence density image pattern is formed by large-sized units corresponding to a large-sized position deviation and having the small-sized position deviation correspondence density image pattern formed by the small-sized units corresponding to the small-sized position deviation, it is possible to obtain a size-mixed chart corresponding to two types of position deviations.

Thus, it is possible to obtain three types of size-mixed charts associated with two types of position deviations.

Further, it is possible to obtain a streak unevenness correction chart set that includes at least four streak unevenness correction charts including at least one of the above-described image size charts 10 and 20, at least one of the head size charts 30 and 40, at least one of the pixel size charts 50 and 60, and at least one of the size-mixed chart 70, the three types of size-mixed charts associated with two types of position deviations, and the size-mixed charts having an additional function of the optical dot gain correspondence pattern.

In this way, by setting the streak unevenness correction charts associated with position deviations having different sizes as the streak unevenness correction chart set, it is possible to accurately perform position deviation correction with respect to various position deviations having different sizes. As a result, it is possible to create a streak unevenness correction LUT capable of accurately correcting streak unevenness due to variation or the like of ejection characteristics of the ejection nozzles of the inkjet printer. Further, by using the created streak unevenness correction LUT, it is possible to correct streak unevenness of an image output from the inkjet printer, to thereby obtain an image without streak unevenness.

The streak unevenness correction charts and the streak unevenness correction chart set used in the invention are basically configured as described above.

Then, respective steps of the streak unevenness correction table creation method of the invention using the streak unevenness correction chart will be described in detail.

Figure 6:
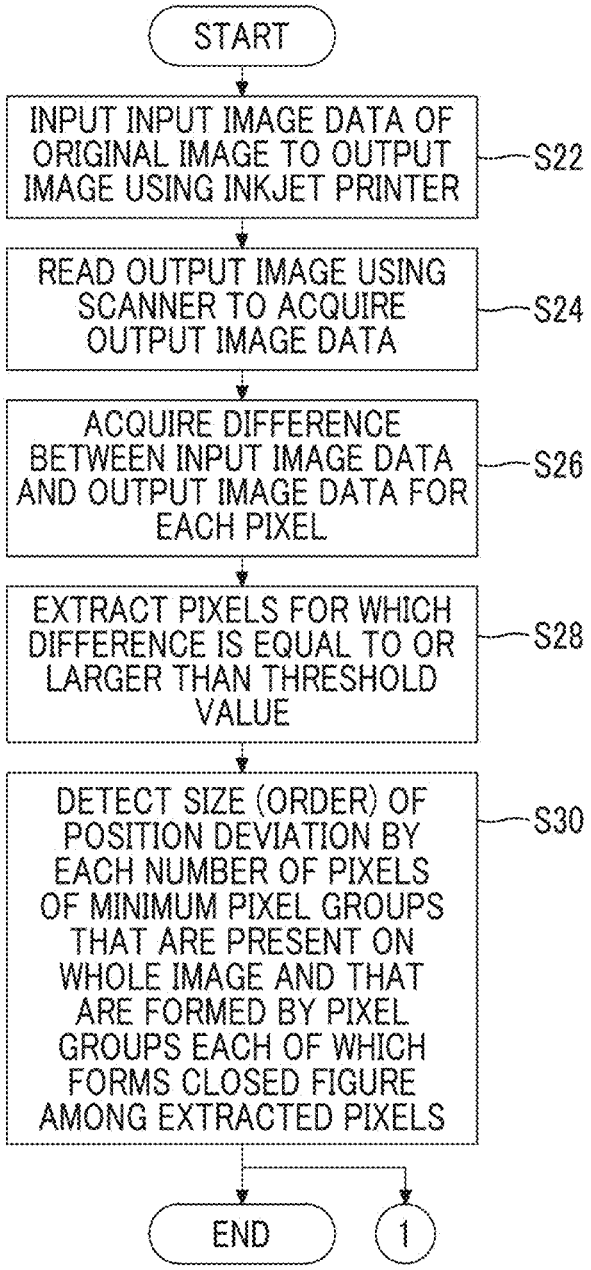
FIG. 6 is a flowchart illustrating an example of a position deviation order detection method of the invention performed in the streak unevenness correction table creation method shown in FIG. 1.

FIG. 6 is a flowchart illustrating an example of a position deviation order detection method performed in step S10 of the streak unevenness correction table creation method shown in FIG. 1.

First, in the position deviation order detection streak unevenness correction table creation method, in step S22, input image data on an original image is input to the inkjet printer, and then, a predetermined output image is output from the inkjet printer.

Here, the original image is not particularly limited, and may be a general arbitrary image, may be an image pattern of a streak unevenness correction chart in the related art, or may be a streak unevenness correction chart density image pattern.

Further, the inkjet printer used herein is not particularly limited as long as plural inkjet heads in which plural inkjet ejection nozzles are arranged in the main scanning direction are arranged in the main scanning direction therein. The inkjet printer may be any type of inkjet printer such as a shuttle type inkjet printer or a full-line type inkjet printer, but the full-line inkjet printer is preferably used. A sheet feed type inkjet printer, a cut sheet type inkjet printer, a continuous sheet (belt or web) type inkjet printer may also be used.

Colors or types of inks output from the ink ejection nozzles of the inkjet printer are not particularly limited, and known colors or types of inks in printing such as CMYK may be used. A streak unevenness correction LUT for correcting streak unevenness is created for each ejection nozzle for each color, with respect to all ink ejection nozzles that eject the inks. Here, the input image data may be density data for each color, for example, on CMYK. Gradations of the density data are not particularly limited, and for example, 256 gradations with 8 bits.

A resolution of the inkjet printer is not particularly limited, and may be any resolution. For example, 600 dpi, 1200 dpi or the like may be used. The number of ink ejection nozzles of the inkjet printer may be set according to a resolution necessary in the inkjet printer.

Then, in step S24, the output image output in step S22 is read by a scanner to acquire output image data.

The scanner used herein is not particularly limited, and may be a scanner of any reading type. The output image data output when reading the output image by the scanner is not particularly limited, and for example, may be RGB density data. Gradations are not particularly limited, and for example, may be 256 gradations with 8 bits. In a case where colors of the input image data and the output image data do not match each other, the colors may be arranged by conversion. The conversion may be performed using a complementary color relationship, or may be performed using one or two colors in the output image data.

Subsequently, in step S26, a difference between the input image data on the original image input to the printer in step S22 and the output image data on the output image read in step S24 is calculated and acquired for each pixel.

Then, in step S28, the difference calculated in step S26 is compared with a predetermined threshold value, and a pixel for which the difference is equal to or larger than the threshold value is extracted.

Here, the predetermined threshold value may be set according to the input image data and the output image data or according to the difference, but in the invention, it is preferable that the input image data and the output image data are RGB data and are represented, where the RGB data is represented by 256 gradations with 8 bits, by ⅓ of the entire gradations, that is, 86 gradations. Here, where the difference is calculated for each of R, G, and B, it is preferable to extract pixels for which a maximum value among the differences for R, G, and B data or the difference for G data exceeds the threshold value.

Then, in step S30, the size (size within a position deviation order) of a position deviation of an image is detected according to the number of pixels of a pixel group that forms a closed figure among the pixels extracted in step S28.

Here, the detection of the size (size within the position deviation order) of the position deviation of the image is performed by determining the size of the position deviation of the image according to each number of pixels of minimum pixel groups that are present on the whole image and that are formed by pixel groups each of which forms a closed figure among the pixels extracted in step S28.

Where 90% or more of the minimum pixel groups are formed by one to ten pixels, it is preferable to determine that the size of the position deviation of the image is within a pixel size order.

Further, where 90% or more of the minimum pixel groups are formed by a size of 0.8 to 1.2 times the number of pixels that form the inkjet heads, it is preferable to determine that the size of the position deviation of the image is within a head size order.

In addition, where the inkjet printer includes plural inkjet heads arranged in the main scanning direction and 90% or more of the minimum pixel groups are formed by pixels of which the number is larger than 1.2 times the number of pixels that form the inkjet heads and is equal to or smaller than a larger one of the number of longitudinal pixels and the number of transverse pixels in an image size, it is preferable to determine that the size of the position deviation of the image is within an image size order.

Furthermore, where the pixel group that forms the closed figure among the extracted pixels does not satisfy a regulation of the number of pixels regulated above, it is preferable to determine that the size of the position deviation of the image is a mixed size having sizes within at least two of the pixel size order, the head size order, and the image size order.

Figure 7:
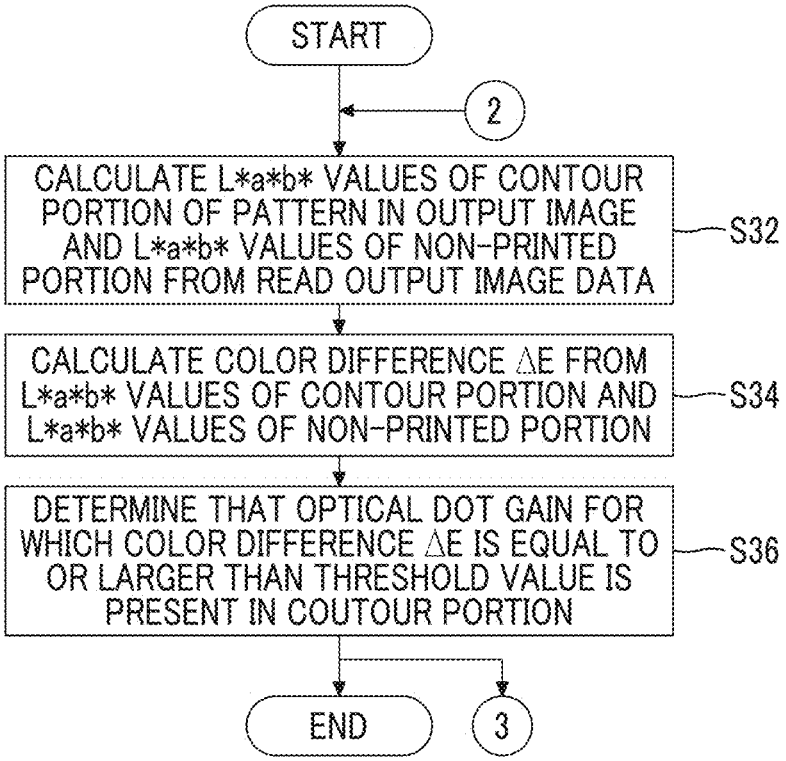
FIG. 7 is a flowchart illustrating an example of an optical dot gain detection method, performed in the streak unevenness correction table creation method shown in FIG. 1.

FIG. 7 is a flowchart illustrating an example of an optical dot gain detection method performed in step S12 of the streak unevenness correction table creation method shown in FIG. 1.

First, in the optical dot gain detection method, it is preferable to calculate, from output image data of an output image read using a scanner, the degree of an optical dot gain generated in a contour portion of a pattern in the output image.

Figure 8:
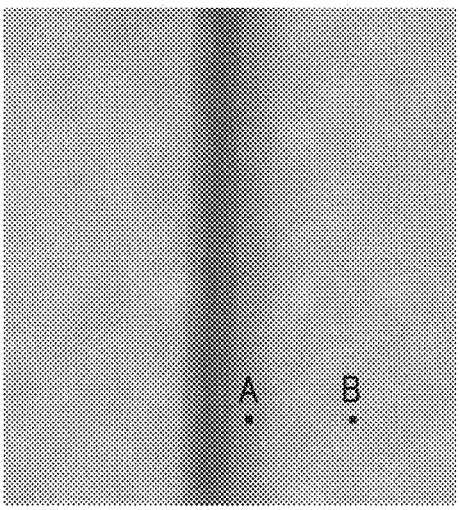
FIG. 8 is a diagram illustrating an example of an image used in the optical dot gain detection method shown in FIG. 7.

That is, specifically, in step S32, it is preferable to calculate an L* value, an a* value and a b* value, in an L*a*b* standard color space, of a portion where the optical dot gain of the contour portion of the pattern in the output image is generated, represented by a point A of an image shown in FIG. 8, and an L* value, an a* value and a b* value of a non-printed portion, represented by a point B of the image shown in FIG. 8, from the output image data of the output image read in step S24.

Then, in step S34, a color difference ΔE between the L*a*b* values of the portion where the optical dot gain is generated and the L*a*b* values of the non-printed portion is calculated, calculated in step S32, and the color difference ΔE may be calculated as the degree of the optical dot gain.

Then, in step S36, the degree of the optical dot gain calculated in step S34 is compared with a predetermined value, and it is determined that an optical dot gain of which the degree is equal to or larger than the threshold value is to be taken into account.

Specifically, the threshold value is set to 0.8 which is a boundary between a level at which a color difference is slightly sensed through comparison of adjacent colors (allowable color difference range including a general instrumental difference between color measurement machines) and a limit capable of setting a strict allowable color difference standard in view of reproducibility of visual determination, with respect to the color difference ΔE, and it is determined that an optical dot gain for which the color difference ΔE is equal to or larger than 0.8 is not ignorable and is an optical dot gain to be taken into account. That is, it is determined that an optical dot gain is present.

In this way, when selecting a streak unevenness correction chart according to the size of a position deviation of an image, the optical dot gain determined to be taken into account is used for selecting a streak unevenness chart (the image size chart 20, the head size chart 40, the pixel size chart 60, the size-mixed chart having an overlap portion in units of the pixel size order, or the like) having an overlap portion when viewing end portions of the units that form the density image pattern in the sub scanning direction.

The reason why a streak unevenness correction chart including an optical dot gain correspondence pattern having an overlap portion in units is selected in a case where an optical dot gain is present and the influence of the optical dot gain can be eliminated may be considered as follows.

As shown in FIG. 8, in a contour portion of an arbitrary lattice that forms a streak unevenness correction chart, an optical dot gain (that is, blurring) is generated due to scattering of light in a base member thereof. Thus, in a case where the base material which is a target easily generates an optical dot gain, a density signal value of a dot (ink) that forms the contour portion of the lattice is not an accurate value and includes an error. Thus, as in a streak unevenness correction chart having an overlap portion, such as the image size chart 20, the head size chart 40, or the pixel size chart 60, lattices having the same density arranged in the sub scanning direction in two rows are arranged so that a contour portion of a lattice in the first row is covered with a lattice in the second row. Thus, instead of a density signal value of a contour portion (for example, point A in FIG. 8) of the lattice in the first row having an error due to an optical dot gain, it is possible to create a table using a density information value of the same portion in the second row that is not influenced by an optical dot gain (a portion which is not a contour portion, for example, the point B in FIG. 8). That is, in a case where the base material which is the target easily generates an optical dot gain, by employing, as a density signal value of a contour portion (point A in FIG. 8) of an arbitrary lattice, a density signal value at a position (point B in FIG. 8) corresponding to the same place in a different lattice deviated in the sub scanning direction at the same density, it is possible to cancel the influence of the optical dot gain to create a table with high accuracy.

Figure 9:
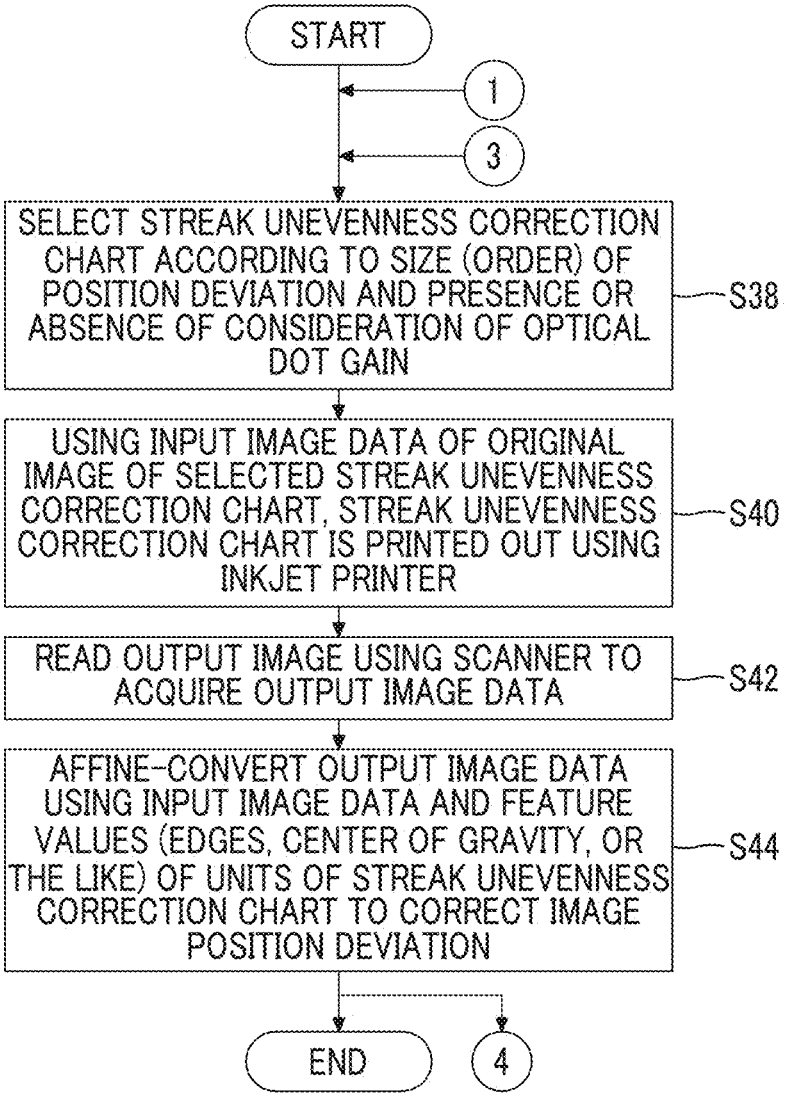
FIG. 9 is a flowchart illustrating an example of an image position deviation correction method of the invention performed in the streak unevenness correction table creation method shown in FIG. 1.

FIG. 9 is a flowchart illustrating an example of an image position deviation correction method performed in step S16 of the streak unevenness correction table creation method shown in FIG. 1.

First, in step S38, a streak unevenness correction chart is selected according to the size (order) of the position deviation of the image detected in step S30 and the presence or absence of consideration of the optical dot gain determined in step S36.

Specifically, in a case where it is not necessary to consider the optical dot gain, a streak unevenness correction chart having a density image pattern including plural units having a size corresponding to the size (order) of the position deviation of the image is selected. In a case where it is necessary to consider the optical dot gain, a streak unevenness correction chart having a size corresponding to the size (size within a size order) of the position deviation of the image and having an overlap portion when viewing end portions of units in the sub scanning direction is selected.

Then, in step S40, using input image data of an original image for printing the streak unevenness correction chart selected in step S38, the streak unevenness correction chart is printed out using the inkjet printer.

Then, in step S42, an output print image of the streak unevenness correction chart printed in step S40 is read using a scanner, so that output image data of the print image of the streak unevenness correction chart read by the scanner is acquired.

Then, in step S44, a position deviation of the output image data acquired in step S42 is corrected using the input image data used in step S42 and feature values (edges, the center of gravity, or the like) of the units.

Specifically, the output image data is affine-converted using the input image data and the feature values (edges, the center of gravity, or the like) of the units, so that a position deviation of the output image data acquired in step S42 is corrected.

Then, as described above, in step S18 shown in FIG. 1, using the output image data in which the position deviation is corrected in step S44 and the input image data of the streak unevenness correction chart used in step S40, a correction table for correcting streak unevenness generated in the image printed by the inkjet printer is created for each of the plural ink ejection nozzles of the plural inkjet heads of the inkjet printer. Here, the correction table is a streak unevenness correction LUT indicating a relationship between signal values applied to the ink ejection nozzles and densities of dots formed by the inks ejected from the ink ejection nozzles.

Hence, the streak unevenness correction table creation method shown in FIG. 1 is terminated.

Then, as described above, in step S20 shown in FIG. 1, using the streak unevenness correction table created in step S18, signal values applied to the plural ink ejection nozzles of the plural inkjet heads of the inkjet printer are adjusted, a non-evenness image of which densities due to ejected inks are appropriately adjusted is formed. Hence, the streak unevenness correction method is terminated.

Figure 10:
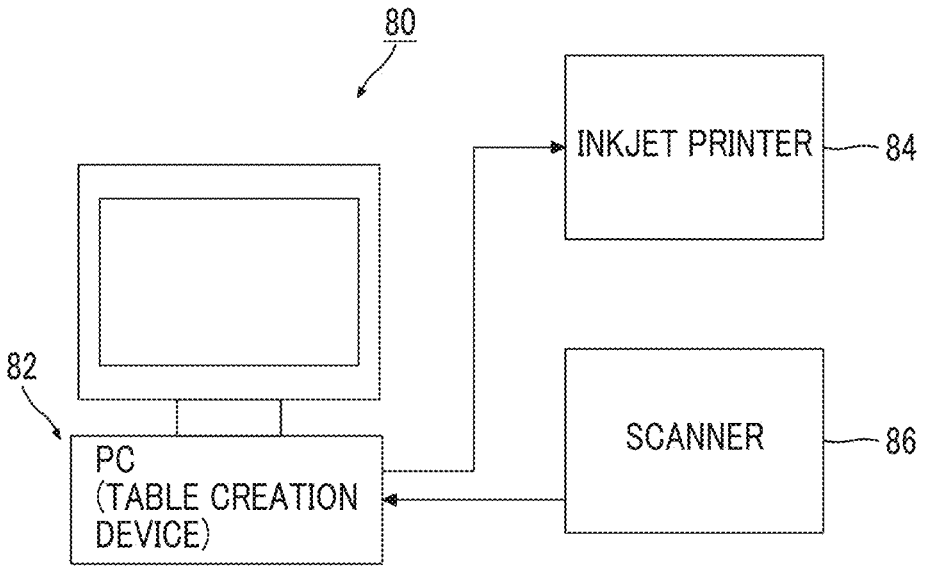
FIG. 10 is a block diagram schematically illustrating an example of a configuration of a streak unevenness correction table creation system that realizes the streak unevenness correction table creation method shown in FIG. 1.

FIG. 10 is a block diagram schematically illustrating an example of a configuration of a streak unevenness correction table creation system that realizes the streak unevenness correction table creation method shown in FIG. 1.

As shown in FIG. 10, a streak unevenness correction table creation system 80 includes a personal computer (PC) 82 which is a streak unevenness correction table creation device, an inkjet printer 84, and a scanner 86.

The PC 82 executes steps S26 to S36, S38 and S44 of the position deviation order detection method, the optical dot gain detection method, and the image position deviation correction method shown in FIGS. 6, 7 and 9, respectively performed in steps S14 and S18, steps S10, and S12 and S16 of the streak unevenness correction table creation method shown in FIG. 1, and stores a variety of data such as input image data of an original image, image data of an output image, and a streak unevenness correction table.

The inkjet printer 84 executes steps S22 and S40 for printing out an output image based on the input image data of the original image, performed in steps S10 and S16.

The scanner 86 executes steps S24 and S42 for reading the output image which is printed out, performed in steps S10 and S16.

Figure 11:
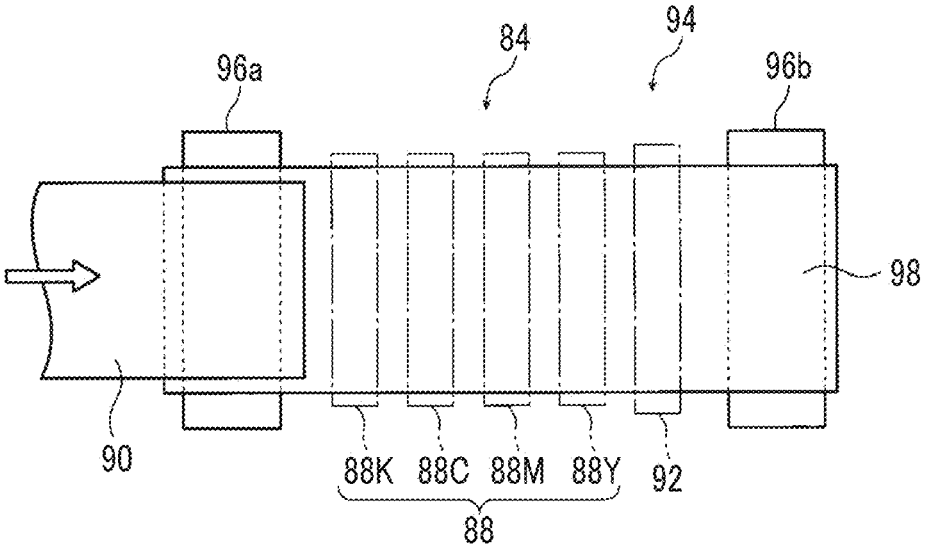
FIG. 11 is a plan view schematically illustrating an example of a configuration of main parts of an inkjet printer of the streak unevenness correction table creation system shown in FIG. 10.

FIG. 11 is a plan view schematically illustrating an example of a configuration of main parts of an inkjet printer of the streak unevenness correction table creation system shown in FIG. 10.

An inkjet printer 84 shown in FIG. 11 includes a print head 88 including plural inkjet print heads (hereinafter, simply referred to as heads) 88K, 88C, 88M, and 88Y provided in association with respective inks of black (K), cyan (C), magenta (M), and yellow (Y); an ink tank (not shown) that stores inks to be supplied to the respective heads 88K, 88C, 88M, and 88Y; a paper feed unit (not shown) that supplies a soft packaging member 90 which is a recording medium; a print detection unit 92 that reads a print result based on the print head 88; and a transport unit 94 that is arranged to face a nozzle surface (ink ejection surface) of the print head 88 and transports the soft packaging member 90 while retaining flatness of the soft packaging member 90.

The transport unit 94 has a structure in which an endless belt 98 is wound on rollers 96*a* and 96*b*, and is configured so that at least a portion that faces the nozzle surface of the print head 88 and a sensor surface of the print detection unit 92 forms a horizontal surface (flat surface).

Each of the heads 88K, 88C, 88M, and 88Y of the print head 88 is a full-line type head that has a length corresponding to a maximum paper width of the soft packaging member 90 which is a target of the inkjet printer 84, in which plural ink ejection nozzles are arranged on the nozzle surface thereof over a length (whole length of a drawable range) that exceeds at least one side of a recording medium of a maximum size.

The heads 88K, 88C, 88M, and 88Y are arranged in the order of colors of black (K), cyan (C), magenta (M), and yellow (Y) from an upstream side along a feed direction of the soft packaging member 90, and the heads 88K, 88C, 88M, and 88Y are fixedly provided to extend along a direction approximately orthogonal to the transport direction of the soft packaging member 90.

A color image may be formed on the soft packaging member 90 by ejecting inks of different colors from the respective heads 88K, 88C, 88M, and 88Y while transporting the soft packaging member 90 by the transport unit 94.

In this way, according to the configuration in which the full-line type heads 88K, 88C, 88M, and 88Y having nozzle arrays that cover the whole area of the paper width, it is possible to record an image on the whole surface of the soft packaging member 90 by performing only an operation of relatively moving the soft packaging member 90 and the print head 88 in the paper feed direction (sub scanning direction) once (that is, through one sub scanning). Thus, it is possible to perform high speed printing compared with a shuttle type head in which a recording head reciprocates in a direction orthogonal to a paper transport direction, to thereby enhance productivity.

Figure 12:
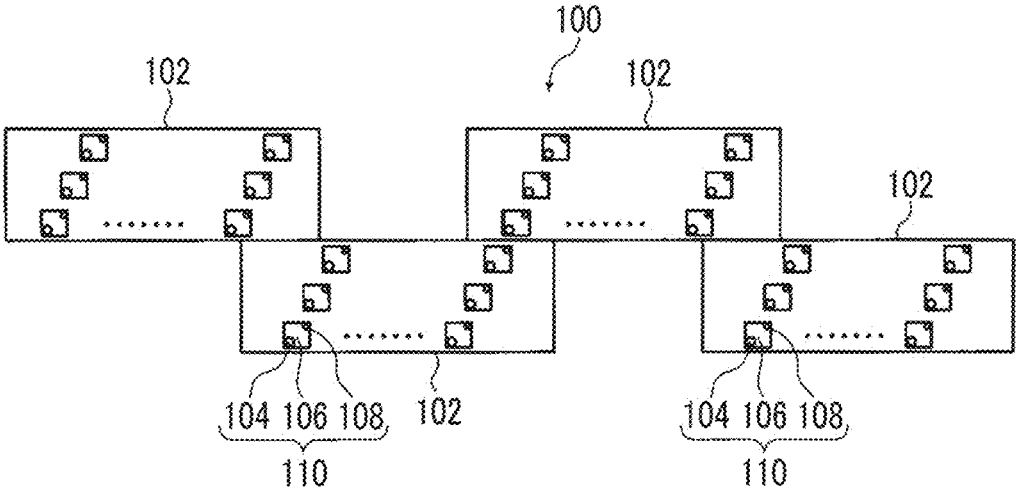
FIG. 12 is a perspective plan view schematically illustrating a configuration of a full-line type print head of the inkjet printer shown in FIG. 11.

FIG. 12 is a perspective plan view schematically illustrating an example of a configuration of the full-line type print head of the inkjet printer shown in FIG. 11.

A print head 100 shown in FIG. 12 representatively shows the heads 88K, 88C, 88M, and 88Y having common head structures.

The print head 100 is a full-line type print head including a nozzle array of a length corresponding to the whole width of the soft packaging member 90, formed by arranging inkjet heads 102 which are plural, in this example, four short head modules in a main scanning direction in zigzag and by connecting the inkjet heads 102.

The print head 100 has a structure in which plural ink chamber units (ink ejection elements) 110 formed by nozzles 104 which are ink ejection ports, pressure chambers 106 corresponding to the respective nozzles 104, and the like are arranged in a matrix form (in two dimensions) in zigzag so as to achieve a high density of dot pitches printed on the soft packaging member 90. Thus, a high density of substantial nozzle intervals (projection nozzle pitches) projected to be arranged along a head length direction (direction orthogonal to the paper feed direction) is achieved.

Each pressure chamber 106 provided corresponding to each nozzle 104 has an approximately square shape in a planar view. An outlet port connected to the nozzle 104 is provided on one of both corners on a diagonal line, and an inlet port (supply port) 108 for a supplied ink is provided on the other end thereof. The shape of the pressure chamber 106 is not limited to this example, and the planar shape may be various shapes, for example, a polygon such as a rectangle (diamond shape, rectangle, or the like), a pentagon or a hexagon, a circle, an oval, or the like.

Hereinbefore, the various embodiments and examples with respect to the position deviation order detection method, the image position deviation correction method, the streak unevenness correction table creation method, and the streak unevenness correction method have been described in detail, but the invention is not limited to these embodiments and examples, and may have various improvements or modifications in a range without departing from the concept of the invention.

EXPLANATION OF REFERENCES

10, 20, 30, 40, 50, 60, 70: streak unevenness correction chart
12, 22, 32, 42, 52, 62, 72, 76, 78: unit
14, 24, 34, 44, 54, 64, 74: density image pattern
26, 46, 66: overlap portion
80: streak unevenness correction table creation system
82: personal computer (PC)
84: inkjet printer
86: scanner
88: print head
88K, 88C, 88M, 88Y: inkjet print head
90: soft packaging member

What is claimed is:

1. A position deviation order detection method for detecting, in order to determine a streak unevenness correction chart that has a size corresponding to the size of a position deviation of an image generated when the image printed by an inkjet printer is read using a scanner and includes a density image pattern formed by a plurality of units for correcting the position deviation of the image, the size of the position deviation of the image, the method comprising:

calculating a difference between input image data of an original image used for printing the image by the inkjet printer and output image data obtained by reading the image using the scanner for each pixel;

comparing the calculated difference with a first threshold value and extracting pixels for which the difference is equal to or larger than the first threshold value; and detecting the size of the position deviation of the image according to the number of pixels of a pixel group that forms a closed figure among the extracted pixels.

2. The position deviation order detection method according to claim 1, wherein where the difference is calculated for each of R, G, and B data, the R, G, and B data are represented as 256 gradations with 8 bits, and the first threshold value is represented by ⅓ of the 256 gradations, pixels for which a maximum value of the differences of the R, G, and B data or the difference of the G data exceeds the first threshold value are extracted, and the size of the position deviation of the image is determined according to each number of pixels of a plurality of pixel groups that is present on a whole of the image.

3. The position deviation order detection method according to claim 2, wherein where 90% or more of the plurality of pixel groups are formed by one to ten pixels, it is determined that the size of the position deviation of the image is within a pixel size order.

4. The position deviation order detection method according to claim 3, wherein where the pixel group that forms the closed figure among the extracted pixels does not satisfy requirements for the number of pixels regulated by the position deviation order detection method, it is determined that the size of the position deviation of the image is a mixed size having sizes within at least two of the pixel size order, the head size order, and the image size order.

5. The position deviation order detection method according to claim 2, wherein where the inkjet printer includes a plurality of inkjet heads arranged in a main scanning direction and 90% or more of the plurality of pixel groups are formed by pixels of which the number is 0.8 to 1.2 times the number of pixels that form the inkjet heads, it is determined that the size of the position deviation of the image is within a head size order.

6. The position deviation order detection method according to claim 2, wherein where the inkjet printer includes a plurality of inkjet heads arranged in a main scanning direction and 90% or more of the plurality of pixel groups are formed by pixels of which the number is larger than 1.2 times the number of pixels that form the inkjet heads and is equal to or smaller than a larger one of the number of longitudinal pixels and the number of transverse pixels in an image size, it is determined that the size of the position deviation of the image is within an image size order.

7. An image position deviation correction method comprising:

detecting the size of the position deviation of the image by the position deviation order detection method according to claim 1;

selecting a streak unevenness correction chart that includes a density image pattern formed by a plurality of units having a size corresponding to the size of the position deviation of the image;

printing the streak unevenness correction chart by the inkjet printer using the input image data for printing the selected streak unevenness correction chart;

reading the printed streak unevenness correction chart using the scanner to obtain output image data of a printed image of the streak unevenness correction chart read by the scanner; and correcting the position deviation included in the output image data using the input image data and a feature value of each unit.

8. The image position deviation correction method according to claim 7, wherein the density image pattern of the streak unevenness correction chart includes a plurality of unit arrays which are arranged at a first interval in a sub scanning direction orthogonal to the main scanning direction, each unit array includes a plurality of units that has a size corresponding to the size of the position deviation of the image and is arranged at a second interval in the main direction, each of the plurality of unit arrays includes a plurality of unit groups that includes two unit arrays which are adjacent to each other in the sub scanning direction and has different densities, and the plurality of units included in each unit group has the same density.

9. The image position deviation correction method according to claim 7, wherein the feature value of the unit includes at least one of edges, corners, and the center of gravity of the unit, and the correction of the position deviation is performed by affine-converting the output image data of the printed image of the streak unevenness correction chart using the input image data of the streak unevenness correction chart and the feature value of the unit.

10. The image position deviation correction method according to claim 7, further comprising:

calculating, from image data of an image obtained by reading the image printed by the inkjet printer using the scanner, the degree of an optical dot gain that is generated in a contour portion of a pattern in the read image;

comparing the calculated degree of the optical dot gain with a second threshold value to determine that the optical dot gain of which the degree is equal to or larger than the second threshold value is to be taken into account; and selecting the streak unevenness correction table according to the optical dot gain determined to be taken into account and the size of the position deviation of the image.

11. The image position deviation correction method according to claim 10, further comprising:

calculating an L* value, an a* value and a b* value, in an L*a*b* standard color space, of a portion where the optical dot gain of the contour portion of the pattern in the read image is generated, and an L* value, an a* value and a b* value of a non-printed portion;

calculating a color difference ΔE from the calculated L*a*b* values of the portion where the optical dot gain is generated and the L*a*b* values of the non-printed portion; and setting the calculated color difference ΔE as the degree of the optical dot gain, setting the second threshold value to 0.8, and determining that the optical dot gain for which the color difference ΔE is equal to or larger than 0.8 is an optical dot gain to be taken into account.

12. A streak unevenness correction table creation method comprising:

correcting a position deviation included in the output image data of the printed image of the streak unevenness correction chart using the image position deviation correction method according to claim 7; and creating a correction table for correcting a streak unevenness that is generated in an image output from the inkjet printer for each of a plurality of ink ejection nozzles of a plurality of inkjet heads of the inkjet printer, using the output image data in which the position deviation is corrected and the input image data of the streak unevenness correction chart.

13. The streak unevenness correction table creation method according to claim 12, wherein the correction table is a lookup table indicating a relationship between a signal value applied to each ink ejection nozzle and the density of a dot formed by an ink ejected from the ink ejection nozzle.

14. A streak unevenness correction method comprising:

adjusting signal values applied to the plurality of ink ejection nozzles of the plurality of inkjet heads of the inkjet printer using the correction table created by the streak unevenness correction table creation method according to claim 12; and forming an image in which streak unevenness is corrected using the adjusted signal values.

* * * * *